US011555400B2

(12) United States Patent
Dai et al.

(10) Patent No.: US 11,555,400 B2
(45) Date of Patent: Jan. 17, 2023

(54) DETERMINATION OF MUD-FILTRATE CONTAMINATION AND CLEAN FORMATION FLUID PROPERTIES

(71) Applicant: Halliburton Energy Services, Inc., Houston, TX (US)

(72) Inventors: Bin Dai, Spring, TX (US); Dingding Chen, Tomball, TX (US); Christopher Michael Jones, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/444,365

(22) Filed: Aug. 3, 2021

(65) Prior Publication Data

US 2021/0372281 A1 Dec. 2, 2021

Related U.S. Application Data

(63) Continuation of application No. 16/494,863, filed as application No. PCT/US2018/063736 on Dec. 4, 2018, now Pat. No. 11,118,451.

(51) Int. Cl.
*E21B 49/00* (2006.01)
*E21B 49/08* (2006.01)

(52) U.S. Cl.
CPC ..... *E21B 49/005* (2013.01); *E21B 49/0875* (2020.05)

(58) Field of Classification Search
CPC ... E21B 49/005; E21B 49/0875; E21B 49/087
See application file for complete search history.

(56) References Cited

U.S. PATENT DOCUMENTS 6,748,328 B2 6/2004 Storm, Jr. et al.
2003/0229448 A1 12/2003 Bruce, Jr. et al.
(Continued)

FOREIGN PATENT DOCUMENTS

WO 2018144606 A1 8/2018
WO 2020005238 A1 1/2020

OTHER PUBLICATIONS

PCT Application Serial No. PCT/US2018/063736, International Search Report, dated Aug. 23, 2019, 3 pages.
(Continued)

*Primary Examiner* — D. Andrews
(74) *Attorney, Agent, or Firm* — Delizio, Peacock, Lewin & Guerra

(57) ABSTRACT

A system to determine a contamination level of a formation fluid, the system including a formation tester tool to be positioned in a borehole, wherein the borehole has a mixture of the formation fluid and a drilling fluid and the formation tester tool includes a sensor to detect time series measurements from a plurality of sensor channels. The system includes a processor to dimensionally reduce the time series measurements to generate a set of reduced measurement scores in a multi-dimensional measurement space and determine an end member in the multi-dimensional measurement space based on the set of reduced measurement scores, wherein the end member comprises a position in the multi-dimensional measurement space that corresponds with a predetermined fluid concentration. The processor also determines the contamination level of the formation fluid at a time point based the set of reduced measurement scores and the end member.

17 Claims, 7 Drawing Sheets

(56) References Cited

U.S. PATENT DOCUMENTS

| | | | |
|---|---|---|---|
| 2013/0340518 | A1 | 12/2013 | Jones et al. |
| 2015/0142317 | A1 | 5/2015 | Zuo et al. |
| 2015/0226059 | A1 | 8/2015 | Zuo et al. |
| 2016/0061743 | A1 | 3/2016 | Wang et al. |
| 2021/0047924 | A1 | 2/2021 | Kallehbasti et al. |
| 2021/0054738 | A1 | 2/2021 | Dai et al. |
| 2021/0071522 | A1 | 3/2021 | Dai et al. |

OTHER PUBLICATIONS

PCT Application Serial No. PCT/US2018/063736, International Written Opinion, dated Aug. 23, 2019, 5 pages.

DETERMINATION OF MUD-FILTRATE CONTAMINATION AND CLEAN FORMATION FLUID PROPERTIES

BACKGROUND

The disclosure generally relates to the field of measuring formation fluid properties, and more particularly to increasing accuracy in formation fluid measurements.

Hydrocarbon producing wells include wellbores that are typically drilled at selected locations into subsurface formations in order to produce hydrocarbons. A drilling fluid, which can also be referred to as "mud," is used during drilling of the wellbores. Mud serves a number of purposes, such as cooling of the drill bit, carrying cuttings to the surface, provide pressure to maintain wellbore stability, prevent blowouts, seal off the wellbore, etc. During and after drilling, the mud filtrate mixes with the fluid contained in the formation (formation fluid) and contaminates the formation fluid. For safety purposes, a majority of the wellbores are drilled under over-burdened or overpressure conditions, i.e., the pressure gradient in the wellbore due to the weight of the mud column being greater than the natural pressure gradient of the formation in which the wellbore is drilled. Because of the overpressure condition, the mud penetrates into the formation surrounding the wellbore to varying depths, thereby contaminating the natural fluid contained in the formation.

In formation sampling and testing, data from a downhole sensor are routinely converted to variable inputs of fluid characterization models. However, the accuracy of this analysis is reduced by factors such as an improperly selected calibration or unexpected physical perturbations near the sensor. This inaccuracy is exacerbated by the contaminant effects of the mud in the formation fluid.

BRIEF DESCRIPTION OF THE DRAWINGS

Embodiments of the disclosure may be better understood by referencing the accompanying drawings.

DESCRIPTION

Figure 1:
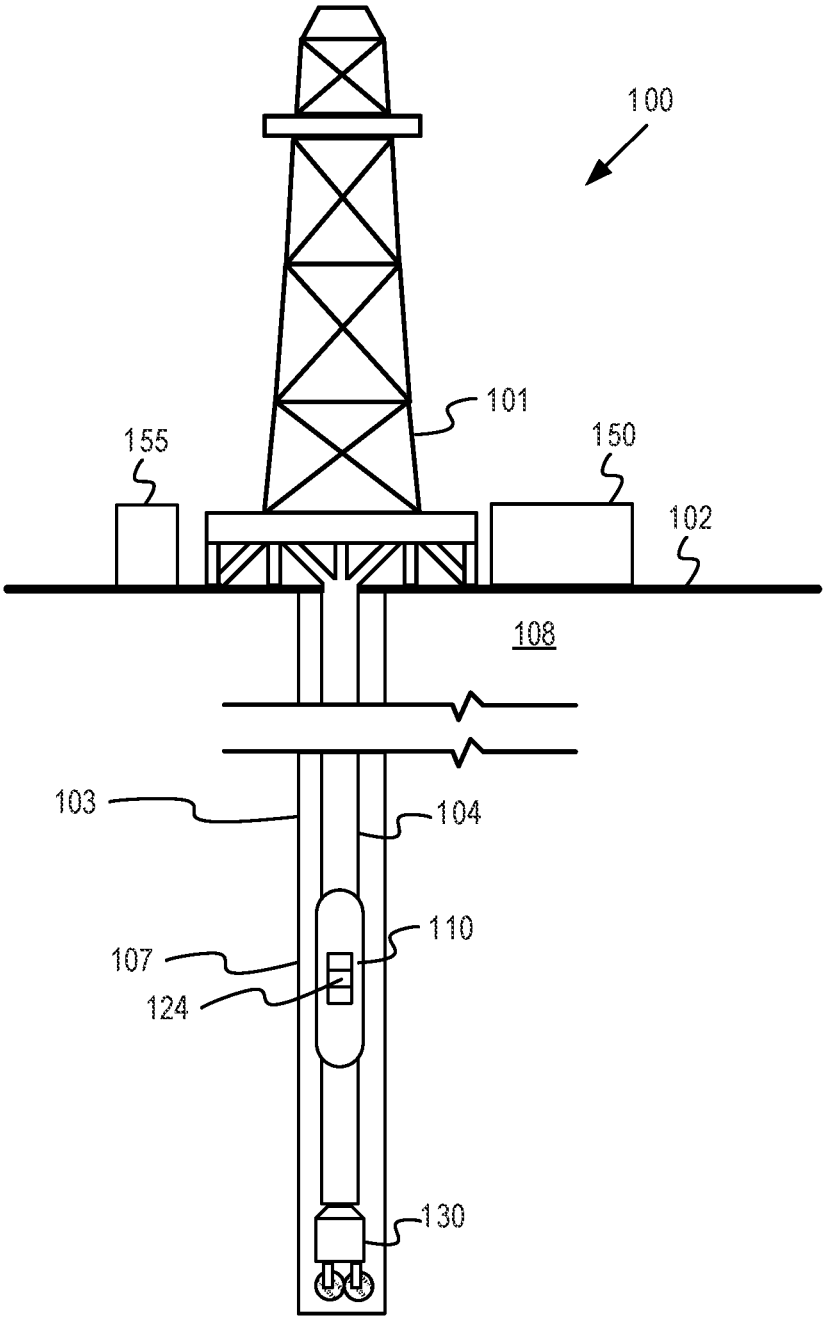
FIG. 1 is an elevation view of an onshore platform operating a downhole drilling assembly that includes a formation tester tool.

The description that follows includes example systems, methods, techniques, and program flows that embody embodiments of the disclosure. However, it is understood that this disclosure can be practiced without these specific details. For instance, this disclosure refers to optical sensors in illustrative examples. Aspects of this disclosure can be instead applied to other sensors such as a viscosity sensor, pressure sensor, or temperature sensor. In other instances, well-known instruction instances, protocols, structures and techniques have not been shown in detail in order not to obfuscate the description.

Various embodiments relate to systems and methods that include multivariant factor analysis that allows data from multiple downhole sensors to be used to obtain a reliable and accurate estimation of levels of contamination (introduced by drilling fluid) in formation fluids. Systems and methods can include using multivariate sensor measurements from a formation tester tool to measure the contamination levels in the formation fluid. The formation tester tool can be part of a bottomhole assembly of a drill string or a wireline tool. During operation, sensors on the formation test tool records time series measurements from a set of sensor channels. The set of sensor channels can include at least three sets of measurements over time, which can be collected as sets of time series measurements. A sensor channel can be the only measurement channel from a sensor or can be one of a group of distinct measurements from a single sensor. For example, the set of sensor channels can include three optical sensor channels from the same optical sensor corresponding with three different frequency bands, a resistivity measurement from a resistivity sensor, and a density measurement from a density sensor, wherein each of the set of sensor channels provide measurements every five minutes.

A system with a computer can then normalize and combine the sets of time series measurements to prepare the time series measurements for dimensional reduction using principal component analysis (PCA). In PCA, orthogonal transformations are used to dimensionally reduced a first data set of measurements in a higher dimensional measurement space into a second data set of PCA elements in a reduced dimensional measurement space (hereinafter "reduced measurement space"), wherein the reduced measurement space is a multi-dimensional measurement space that has fewer dimensions than the higher dimensional measurement space. The system applies PCA to generate a set of principal components vectors as dimensionally reduced representations of the measurements at each time point in the time series (hereinafter "reduced measurement scores"), wherein the reduced measurement scores can have two (or more) PCA elements for each measured time. If the system generates a set of measurement scores into multi-dimensional measurement space having two dimensions (i.e., "two-dimensional measurement space"), the system fits the dimensionally reduced measurements using a reduced measurement prediction curve (hereinafter "prediction curve"). Otherwise, the system can fit the dimensionally reduced measurements using a multivariate fitting method, such by using a surface defined by a multivariate prediction function. The system then determines end members of the prediction curve based on existing sensor knowledge and/or fundamental physical limitations of the sensor(s), wherein the end members are positions in the reduced measurement space that correspond with a predetermined fluid concentration (e.g., 100% formation fluid, 100% drilling fluid, 95% drilling fluid by volume percentage, 0.5 drilling fluid by mass ratio, etc.). Once both the prediction curve and the end members are determined, the system can determine a concentration of the mud contamination level ("contamination level") at a measured time based on the dimensionally reduced measurement corresponding with that time. Moreover, the system can assign a confidence value to the contamination level based on the confidence levels of the associated end members. In addition, the system can use the end members to determine a sensor "fingerprint" for a pure formation fluid, wherein the pure formation fluid contains only formation fluid. A sensor fingerprint is a set of sensor channel measurement values that are specific to a specific fluid or type of fluid. The sensor fingerprint of the pure formation fluid can be used identify a pure formation fluid and determine various properties of the pure formation fluid (e.g., chemicals present in a mixture, ratios of chemicals present in a mixture, density, etc.).

The contamination and formation fluid property determination method described above allows for a robust determination of formation fluid contamination that is adaptable to various systems with different sets of available sensors. In some embodiments, to do so, the method reduces any number of sensor channels into a reduced multi-element interpretation, such as a two-element interpretation. In contrast to conventional operations, the execution time of operations according to various embodiments is reduced in comparison to execution times of conventional operations, such as iterative multivariate methods (e.g., multivariate curve resolution methods). Moreover, by reducing a potentially large set of data into two elements, the system can include visual display components to graphically represent the reduced measurement scores. Once a set of sensor fingerprints corresponding with formation fluids at multiple depths is available, by comparing the sensor fingerprints' similarity, one can determine the reservoir continuity and compartmentalization, which is important for reservoir architecture understanding and reservoir modeling.

Example Systems

FIG. 1 is an elevation view of an onshore platform operating a downhole drilling assembly that includes a formation tester tool. In FIG. 1, a drilling system 100 includes a drilling rig 101 located at the surface 102 of a borehole 103. The drilling system 100 also includes a pump 150 that can be operated to pump mud through a drill string 104. The drill string 104 can be operated for drilling the borehole 103 through the subsurface formation 108 using the drill bit 130.

The drilling system 100 includes a formation tester tool 110 to acquire sensor channel measurements from fluid and fluid mixtures in the borehole, such as a pure formation fluid, a pure drilling fluid, a mixture of formation fluid and drilling fluid, etc. The formation tester tool 110 can be part of the drill string 104 and lowered into the borehole, optionally as part of a bottomhole assembly. The formation tester tool 110 can sample a formation fluid (e.g. draw formation fluid into the formation tester tool 110 from the subsurface formation 108) or a mixture that includes the formation fluid in order to acquire sensor measurements. The formation tester tool 110 in this example includes a set of probes 124 for drawing formation fluid and transfer the formation fluid to a set of sensors of the formation tester tool 110 for measurement. The set of sensors acquire the sensor channel measurements, wherein the sensor channel measurements can include at least one attribute of the mixture of formation fluid and drilling fluid. The set of sensors on the formation tester tool 110 can include optical sensors, resistivity sensors, viscosity sensors, density sensors, pressure sensors, etc. For example, the set of sensors can include an optical sensor that detects five sensor channel measurements as the formation tester tool 110 is lowered into the formation. These channel measurements can be collected over time to form time series measurements. During drilling, mud from the pump 150 can mix with formation fluids flowing into the well 103 from the formation wall 107.

While or after the set of sensors acquire sensor channel measurements, the computer 155 can use the sensor channel measurements to generate dimensionally reduced measurements. The computer 155 can also process the dimensionally reduced measurements to determine a prediction curve and associated end members. The computer 155 can also predict pure formation fluid properties and/or characterize the pure formation fluid coming out of the formation wall 107. Moreover, in response to determining that a pure formation fluid is either not present or does not contain sufficient quantities of one or more target fluids, drilling operations can be altered or stopped. These operations are further described below.

Figure 2:
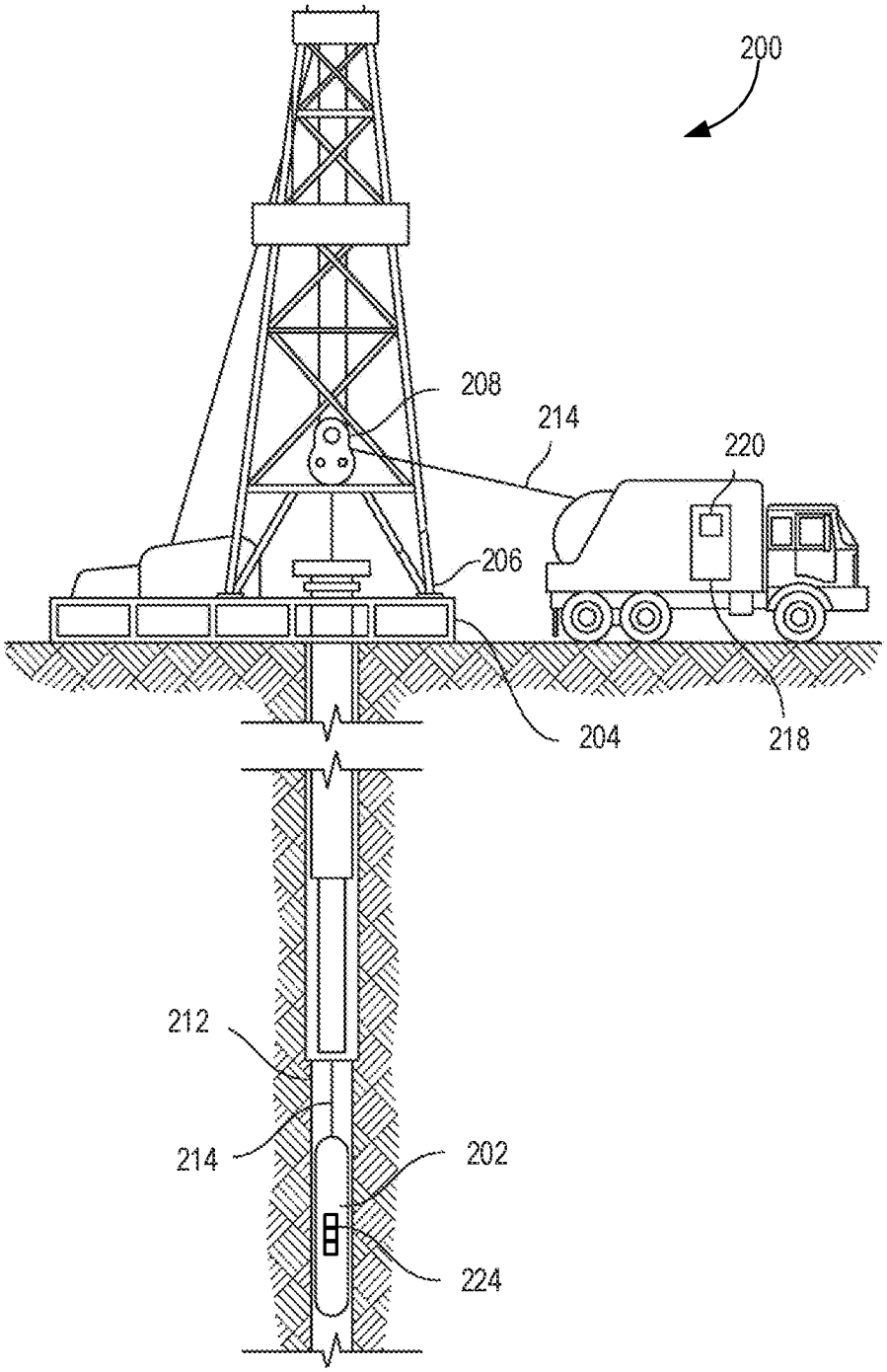
FIG. 2 is an elevation view of an onshore platform operating a wireline tool that includes a formation tester tool.

Alternatively, instead of being attached to an onshore platform operating a downhole drilling assembly, a formation tester tool can be a wireline tool. FIG. 2 is an elevation view of an onshore platform operating a wireline tool that includes a formation tester tool 202. The onshore platform 200 comprises a drilling platform 204 installed over a borehole 212. The drilling platform 204 is equipped with a derrick 206 that supports a hoist 208. The hoist 208 supports the formation tester tool 202 via the conveyance 214, wherein specific embodiments of the conveyance 214 can be slickline, coiled tubing, piping, downhole tractor, or a combination thereof. The formation tester tool 202 can be lowered by the conveyance 214 into the borehole 212. Typically, the formation tester tool 202 is lowered to the bottom of the region of interest and subsequently pulled upward at a substantially constant speed.

The formation tester tool 202 is suspended in the borehole by a conveyance 214 that connects the formation tester tool 202 to a surface system 218 (which can also include a display 220). In some embodiments, the formation tester tool 202 can include a set of probes 224, analogous to the set of probes 124 described in FIG. 1. The set of probes 224 can be employed to draw formation fluid and provide the formation fluid to a set of sensors. The set of sensors acquires sensor channel measurements that can be used to measure formation fluid properties. The sensor channel measurements can be communicated to a surface system 218 via the conveyance 214 for storage, processing, and analysis. The formation tester tool 202 can be deployed in the borehole 212 on coiled tubing, jointed drill pipe, hard-wired drill pipe, or any other suitable deployment technique. In some embodiments, the conveyance 214 can include sensors to acquire sensor channel measurements. The surface system 218 can perform similarly to the computer 155 in FIG. 1 and generate a prediction curve, end members, and pure formation fluid property predictions based on the set of dimensionally reduced measurements (as further described below). While described as being performed by the computer 155 or the surface system 218 at the surface, some or all of these operations can be performed downhole and/or at a location that is remote to the drilling site.

Figure 3:
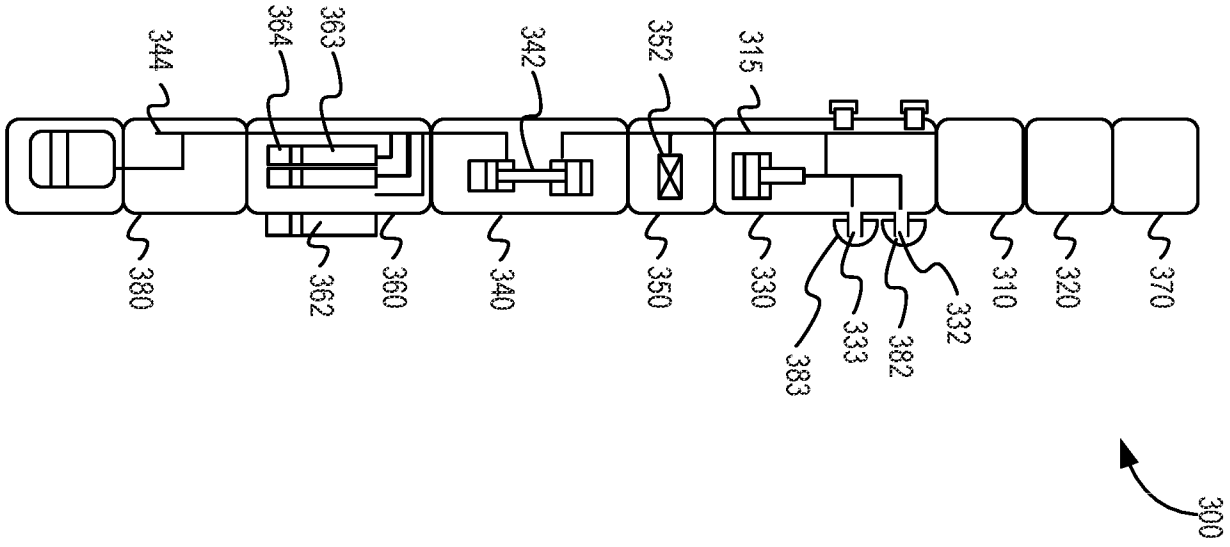
FIG. 3 is a diagram of a modular fluid extraction tool having a formation tester tool.

FIG. 3 is a diagram of a modular fluid extraction tool having a formation tester tool. In FIG. 3, a formation tester tool 300 may include an injection device 310; a power module 320 (e.g. a hydraulic power module capable of converting electrical into hydraulic power); a probe module 330 to take samples of the formation fluids; a flow control module 340 regulating the flow of various fluids in and out of the tool; a fluid test module 350 for performing different tests on a fluid sample; a sample collection module 360 that may contain various size chambers for storage of the collected fluid samples; a power telemetry module 370 that provides electrical and data communication between the modules; an up hole control system (not shown) and other sections 380. Various modules can be rearranged depending on the specific applications, and that the arrangement herein should not be considered as limiting. In some embodiments, the formation tester tool 300 can be the formation tester tool 110 depicted in FIG. 1 or the formation tester tool 202 depicted in FIG. 2.

The power telemetry module 370 conditions power for the remaining tool sections. Each section can have its own process-control system and can function independently. While the power telemetry module 370 provides a common intra-tool power bus, the entire tool string (extensions beyond formation tester tool 300 not shown) can share a common communication bus that is compatible with other logging tools. Such an arrangement would enable the formation tester tool 300 to be combined with other logging systems, including, but not limited to, a Magnetic Resonance Image Logging (MRIL) or High-Resolution Array Induction (HRAI) logging systems.

With reference to FIG. 2, the formation tester tool 300 can be conveyed into the borehole 212 by conveyance 214, which can contain conductors for carrying power to the various components of the formation tester tool 300 and conductors or cables (coaxial or fiber optic cables) for providing two-way data communication between the formation tester tool 300 and the surface system 218. The surface system 218, as described above, can include a computer and associated memory for storing programs/sensor measurements, processing, and analysis. The surface system 218 can control the operation of formation tester tool 300 and process sensor measurements received during operations. The surface system 218 can include, but is not limited to, a variety of associated peripherals, such as a recorder for recording sensor measurements, a display for displaying desired information, and a printer. In a specific embodiment, telemetry module 270 may provide both electrical and data communications between the modules and the surface system 218 (as shown in FIG. 2). In particular, telemetry module 270 provides high-speed data bus from the control system to the modules to download sensor readings and upload control instructions initiating or ending various test cycles and adjusting different parameters, such as the rates at which various pumps are operating.

In some embodiments, the injection device 310 and/or probe module 330 may inject fluids into the formation before collecting samples/measurements or inject fluids into the formation as samples are being collected. The flow control module 340 of the formation tester tool 300 can include a piston pump 342, which can control the formation fluid flow from the earth formation drawn into probes 332 and 333 of the probe module 330. While the formation tester tool 300 is shown to have two probes, alternative formation tester tools can have a different number of probes, such as only one probe or three or more probes. Formation fluid which is drawn in via probes 332 and 333 maybe be taken into a flow line 315 for mobility testing within fluid testing module 350 and/or provided to sample collection module 360. The extracted fluid can be referred to herein as a fluid sample whether used for fluid mobility testing or collection in sample collection module 360. The piston pump 342 can draw fluid from the formation via the probes 332 and 333. The pump operation can be monitored by the surface system 218 shown in FIG. 2. A fluid control device, such as a control valve, can be connected to flow line 315 to control the flow of fluid from the flow line 315. Flow control module 340 may additionally include one or more flow rate sensors and/or pressure sensors such as strain-gauge pressure transducers that can acquire measurements such as flow rate and/or inlet and outlet pump pressures.

In order to test the mobility of the fluid drawn from the formation, the fluid testing section 350 of the formation tester tool 300 can include a fluid testing device having fluid sensors, which can analyze the fluid flowing through flow line 315. For the purpose of this example, any suitable device or devices can be utilized to analyze the fluid mobility of the formation using fluid sensors. These devices for determining fluid mobility may include, but are not limited to, pressure sensors such as quartz pressure crystal pressure transducers/gauges. Additionally, devices may be employed which include a number of different types of sensors. For example, in such gauge carriers the pressure resonator, temperature compensation, and reference crystal are packaged as a single assembly with each adjacent crystal in direct contact. The assembly can be contained in an oil bath that is hydraulically coupled with the pressure being measured. The quartz gauge enables the device to obtain sensor measurements such as the drawdown pressure of fluid being withdrawn from the earth formation and the fluid temperature. In at least one instance, two fluid testing sensor devices 352 can be run in tandem to obtain a pressure difference between fluid testing sensor devices 352 and determine the viscosity of the fluid while pumping is in process or the density of the fluid once flow is stopped. Flow rate sensors can also be employed to determine the flow rate of the fluid being extracted to determine mobility/viscosity of hydrocarbon in the formation. In addition, either the fluid test module 350 or another module of the formation tester tool 300 can include additional sensors such as optical sensors, resistivity sensors, etc., wherein some or all of the sensors of the formation tester tool 300 can be employed in parallel.

Sample collection module 360 of the formation tester tool 300 may contain chambers of various sizes for storage of the collected fluid sample. The sample collection module 360 can include at least one collection tube 362 and can additionally include a piston that divides collection tube 362 into an upper chamber 363 and a bottom chamber 364. A conduit can be coupled with bottom chamber 364 to provide fluid communication between bottom chamber 364 and the outside environment, such as the inner surface of the wellbore. Additionally, a fluid flow control device, such as an electrically controlled valve, can be placed in the conduit to selectively open and close the valve to allow fluid communication between the bottom chamber 364 and the wellbore. Similarly, sample collection module 360 may also contain a fluid flow control device, such as an electrically operated control valve, which is selectively opened and closed to direct the formation fluid from the flow line 315 into the upper chamber 363.

Probe module 330, specifically probes 332 and 333, can have electrical and mechanical components that can facilitate testing, sampling, and extraction of fluids from the earth formation. The probes 332 and 333 can be laterally extendable by one or more actuators inside the probe module 330 to extend the probes 332 and 333 away from the formation tester tool 300. Probe module 330 can retrieve and sample formation fluids throughout an earth formation along the longitudinal axis of the wellbore. The probes 332 and 333 can be coupled with the sealing pads 382 and 383 to provide a sealing contact with the inside surface of the wellbore at a desired location. At least one of the probes 332 and 333 can additionally include one or more strain sensors such as a high-resolution temperature compensated strain gauge pressure transducer (not shown), that can be isolated with shut-in valves to monitor probe pressure. Fluids from the sealed-off part of the earth formation may be collected through one or more slits, fluid flow channels, openings, outlets or recesses in the sealing pad. The recesses in the sealing pad can be elongated along the axis of the pad. While FIG. 3 illustrates a probe module 330 with a single probe, it would be understood by those in the art that any number of probes may be used without diverging from the scope of this description.

Example Operations

Figure 4:
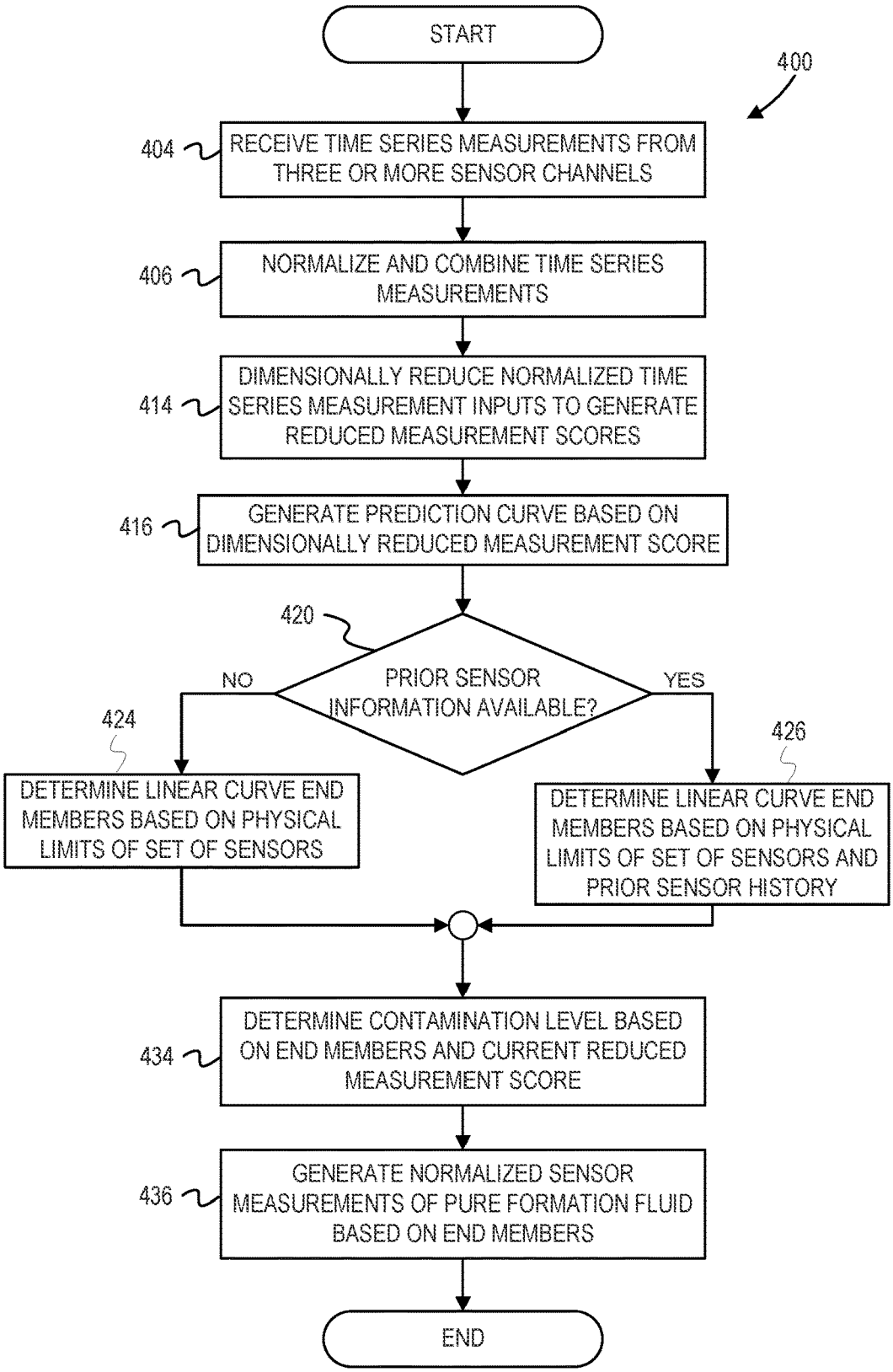
FIG. 4 is a flowchart of operations to generate a reduced measurement prediction curve based on a set of sensor channel measurements.

FIG. 4 is a flowchart of operations to generate a reduced measurement prediction curve based on a set of sensor channel measurements. FIG. 4 is a flowchart 400 that includes operations that are described in reference to the formation tester tools of FIGS. 1-3. Operations of the flowchart 400 start at block 404 and are described with reference to a system that includes a processor to receive sensor channel measurements, perform calculations, and provide instructions for operations.

At block 404, at least one sensor of a formation tester tool detects sets of time series measurements from a number of sensor channels. In some embodiments, the number of sensor channels is at least three. Each set of time series measurements can include measurements from a sensor channel from a sensor or optical fiber in a borehole and the corresponding times at which the measurements were taken, wherein the measurements can include at least one attribute of the mixture of a formation fluid and a drilling fluid. For example, the time series measurements can include a first set of voltage time series measurements, a second set of voltage time series measurements, a first set of optical time series measurements, a second set of optical time series measurements, and a set of pressure time series measurements. In addition, the set of time series measurements can include measurements taken at the surface of a well. For example, the time series measurements can include pressure measurements taken at the surface of the well.

At block 406, the system normalizes and combines the time series measurements. Normalizing and combining time series measurements can include normalizing each row of the time series measurements based on the sum of the row of measurement values at each time point. Normalizing a row of measurements can be performed using Equation 1 below, wherein the combined time series measurements from the sensors are represented by a full sensor data matrix having m measurements and n number of sensors/sensor channels, wherein $X_{i,j}^{new}$ is a normalized value of the sensor measurement $X_{i,j}$, which was taken during the time point i by the sensor channel j:

$$X_{i,j}^{new} = \frac{X_{i,j}}{\sum_{k=1}^{n} X_{i,k}} \tag{1}$$

For example, a set of time series measurements at the time point 10 seconds can include a first voltage measurement of 30 volts, a second voltage measurement of 10 millivolts, a first optical measurement of 30 decibels, a second optical measurement of 60 decibels, and a pressure measurement of 500 pounds per square inch (psi). Each measurement in the set of time series measurements can be normalized into values between 0 and 1 using the value 630, which is the sum of 30, 10, 30, 60, and 500. For example, the normalized value of the first voltage measurement is approximately 0.0476 (i.e., 30/630). While the above example shows sensor channels reporting the same types of physical measurements with different units (e.g., volts and millivolts), data processing schemes can be implemented to convert sensor channels with different units into a shared unit to enforce data consistency. The normalized time series measurements can then be combined into a single array. Alternatively, the normalized time series measurements can be split into sets of arrays.

At block 414, the system dimensionally reduces the normalized time series measurements to generate reduced measurement scores. The system can dimensionally reduce sets of time series measurements by applying PCA to generate a set of principal components vectors having two elements for each measured time. During PCA, a normalized sensor data matrix, which represent the combined normalized time series measurements, can be decomposed into being a product of two matrices. The system performs the decomposition according to Equation 2 below, wherein $X^{new}$ is the normalized sensor data matrix, T is the reduced measurement scores, and Vis a loading matrix (making $V^T$ the transposed loading matrix):

$$X^{new} = T * V^T \tag{2}$$

For example, a combined set of time series measurements can be dimensionally reduced into a in a two-dimensional measurement space, wherein the time series measurements are dimensionally reduced into a first element having a value of 0.044 and a second element having a value of 0.000 at a first time point for T. These elements can be combined to form a reduced measurement score having the coordinates (0.044, 0.000) in a reduced measurement space.

At block 416, the system generates a prediction curve based on the reduced measurement scores. Generating a prediction curve can include using various objective function minimization methods to determine a prediction curve for a two-dimensional set of data. The prediction curve can be linear and can be represented as a linear function with explicit ranges. For example, the prediction curve can be represented by the function "f(x)=−2.3*x+0.1013," wherein x represents the first PCA element, f(x) represents the value predicted by the prediction function for the second PCA element, and x is limited to be between 0.042 and 0.047.

At block 420, the system determines if prior sensor information is available. Prior sensor information can include known information about a sensor's measurements and/or confidence levels associated with the sensor's measurements. For example, if it is known that a voltage measurement should not exceed 55 volts, then the system can incorporate the prior sensor information to discard any measurement exceeding 55 volts during a prediction curve generation method. Prior sensor information can also be used to determine endpoints with greater accuracy than endpoints based only on physical sensor limitations. If proper sensor information is available, operations of the flowchart 400 can proceed to block 426. Otherwise, operations of the flowchart 400 can proceed to block 424.

At block 424, the system determines end members based on the physical limits of the set of sensors. The end members can be or can include positions on a prediction curve that are in the same reduced measurement space as the reduced measurement scores. For example, along a prediction curve in a two-dimensional measurement space having the function "f(x)=10−5*x", the end members can include the positions (1, 5) and (1.5. 2.5) in the reduced measurement space, wherein each position corresponds with a predetermined fluid concentration. In some embodiments, the positions of the end members correspond with limits that are defined by the sensor channel measurements at pure fluid limits, and thus the positions correspond with either the predetermined fluid concentration for pure mud (i.e., 100% mud) or the predetermined fluid concentration for pure formation fluid (i.e., 100% formation fluid). Alternatively, in other embodiments, the end members can correspond with predetermined fluid concentrations of formation fluid and mud. The system can determine an end member based on the intersection between the prediction curve and a limitation boundary, wherein the limitation boundary is generated by dimensionally reducing a set of physical sensor limits. For example, a limitation boundary can be generated by dimensionally reducing the limitation of a density sensor being unable to produce any value less than zero and the limitation of an optical sensor being unable to produce any decibel value less than zero.

At block 426, the system determines end members based on physical limits of a set of sensors and prior sensor information. Similar to block 424 above, the end members can be positions on a prediction curve. In addition to using physical sensor limits, the system can use prior sensor information to generate one or more limitation boundaries. For example, the system can use prior sensor information that includes known sensor channel measurements of a pure mud to generate a pure mud limitation boundary, wherein the intersection between the pure mud limitation boundary and the prediction curve forms an end member corresponding with the pure mud. In addition, the system can use prior sensor information that includes known sensor channel measurements of a pure methane fluid to establish a baseline pure formation fluid limitation boundary. Alternatively, instead of using a pure fluid, a mixture with known concentrations can be established to determine the predetermined concentration that an end member corresponds with. For example, the system can use prior sensor information that includes known sensor channel measurements of a known mixture having 25% formation fluid and 75% drilling fluid as a testing end member. The concentration of this known mixture can be used as the predetermined fluid concentration that the testing end member corresponds with. In addition, if the prior sensor information includes a prior confidence level associated with the sensor, an end member confidence level can be determined based on the prior confidence level.

At block 434, the system determines contamination levels based on end members and the current reduced measurement score. The system can determine the contamination based on a ratio such as that shown in Equation 1, wherein the first distance $d_1$ corresponds to the distance between the current reduced measurement score and the first end member, and the second distance $d_2$ corresponds to the distance between the current reduced measurement score and the second end member $d_2$. The formation fluid purity level $C_1$ and the contamination level $C_2$ can be determined using Equations 3 and 4 below:

$$C_1 = \frac{d_1}{d_1 + d_2} \tag{3}$$

$$C_2 = \frac{d_2}{d_1 + d_2} \tag{4}$$

The distances $d_1$ and $d_2$ can be Euclidean distances between the current reduced measurement score and the first and second end members, respectively. Alternatively, the distances $d_1$ and $d_2$ can be the Euclidean distance between a corresponding point and the first and second end members, respectively, wherein the corresponding point is the nearest point on the prediction curve. For example, if the distance $d_1$ is 0.15 and distance $d_2$ is 0.25, and the first end member corresponds with a pure mud end point, and the second end member corresponds with a pure fluid end point, then the contamination level is 0.625 using equation 4 above. In some embodiments, the purity level or contamination level can be automatically multiplied by 100% to provide the result in percentages. In addition, a confidence value associated with the contamination level can be determined based on an end member confidence level and/or any prior confidence level from the prior sensor information.

In some embodiments, instead of using end members that correspond with pure formation fluid concentration or a pure drilling fluid concentration, end members corresponding with other predetermined fluid concentrations can be used to determine concentration/contamination. For example, Equation 4 can be modified based on the knowledge that a first end member corresponds with a formation fluid concentration of 0.95 and a second end member corresponds with a formation fluid concentration of 0.15 to determine a concentration value.

At block 436, the system generates sensor measurements of pure formation fluid based on the end members. They system can generate virtual normalized pure formation fluid sensor channel measurements (hereinafter "normalized pure measurements") based on the values of the elements of an end member corresponding with the pure formation fluid. The normalized pure measurements V can be used as a fingerprint of a formation fluid. The normalized pure measurements can be determined using Equation 5 below, wherein $X_{endmember}$ are the normalized sensor measurements of a pure formation fluid, $T_{endmember}$ is the end member reduced measurement score, and $V^T$ is the transposed loading matrix as described above for Equation 2:

$$X_{endmember} = T_{endmember} * V^T \tag{5}$$

Once calculated, the normalized pure measurements can be used directly as a sensor fingerprint of the formation fluid to identify the formation fluid and/or determine formation fluid properties. For example, normalized pure measurements having the combined values (0.1, 0.5, 0.3) can be indicative of a formation fluid having at least 90% butane with a density of greater than 2.48 kilograms per cubic meter. Alternatively, the system can use the normalized pure measurements to generate a processed and/or re-dimensionalized fingerprint of the formation fluid by performing addition signal processing methods.

Figure 5:
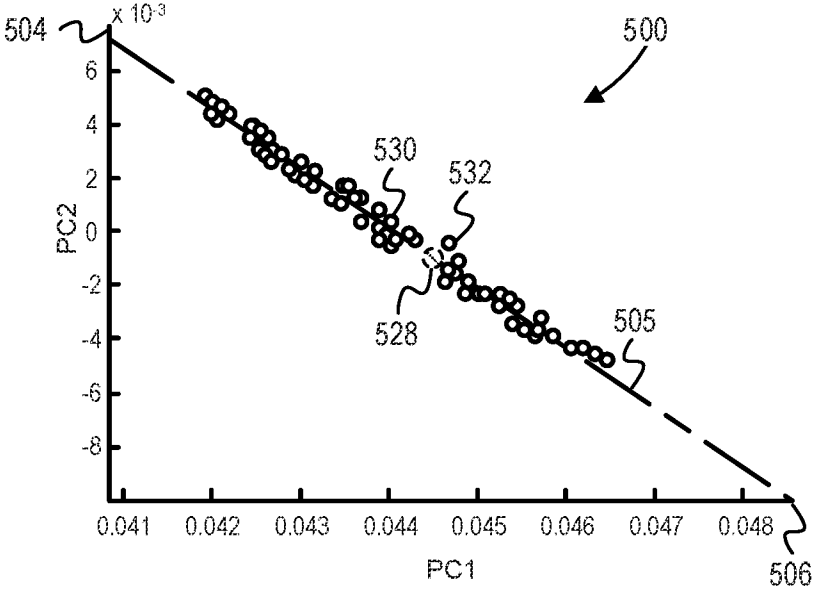
FIG. 5 is an example plot showing a set of reduced measurement scores in a reduced measurement space.

FIG. 5 is an example plot showing a set of reduced measurement scores in a reduced measurement space. A plot 500 has a first PCA ("PC1") axis 502 and a second PCA ("PC2") axis 504. The plot 500 also includes a set of reduced measurement scores 530 which are represented by solid circles. One of the set of reduced measurement scores includes a reduced measurement score 532. The system can generate a prediction curve 505 based on the reduced measurement scores 530, wherein the prediction curve 505 is generated using a minimization method. The reduced measurement score 532 can have a corresponding point 528 on the prediction curve 505 before calculating for the distances used to determine a contamination level. The corresponding point 528 can be determined to be the point at the position closest to the reduced measurement score 532 that is on the prediction curve 505.

Figure 6:
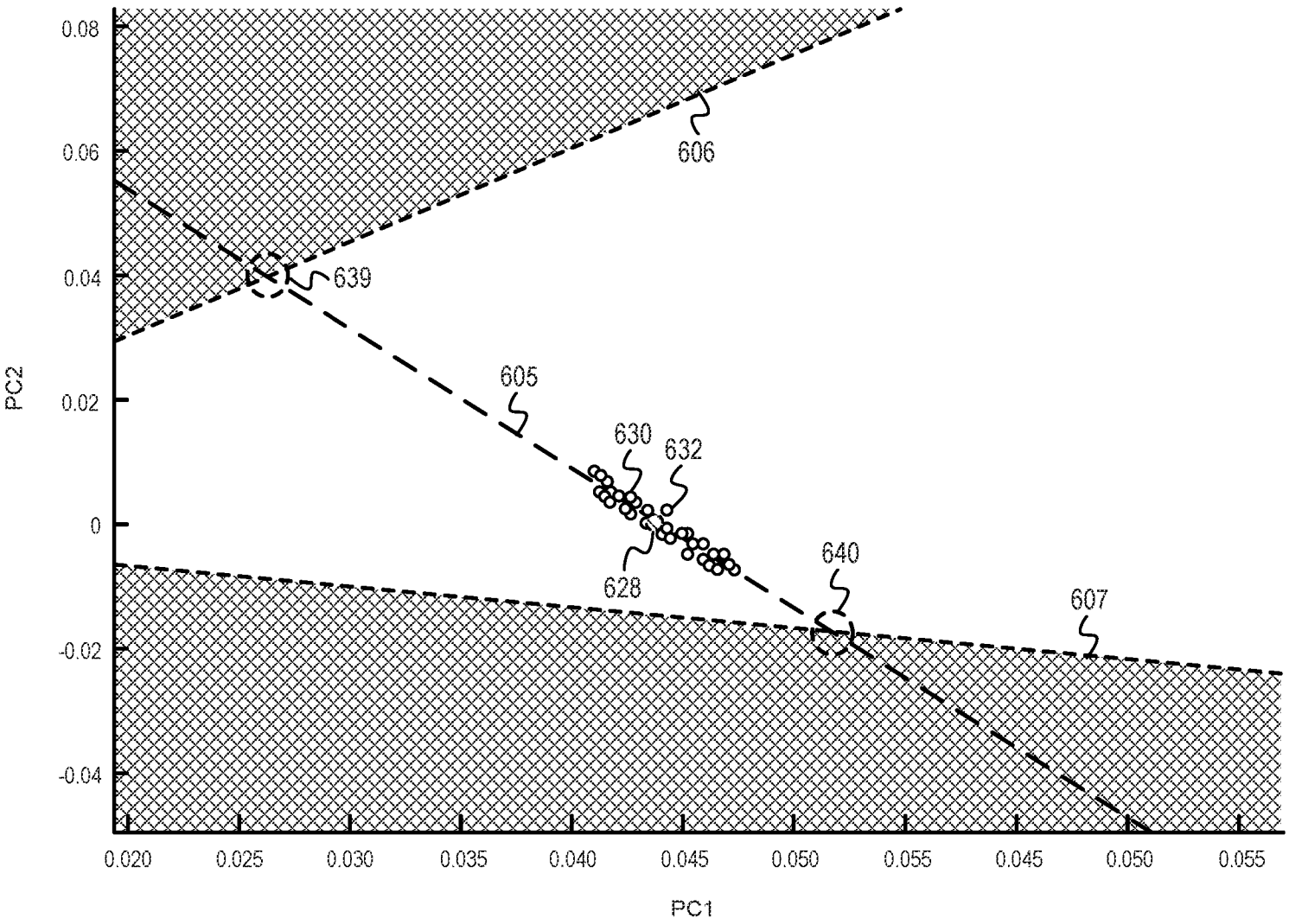
FIG. 6 is an example plot showing a set of reduced measurement scores and end members in a reduced measurement space.

FIG. 6 is an example plot showing a set of reduced measurement scores and end members in a reduced measurement space. FIG. 6 is described with further reference to FIG. 3. The plot 600 has a first PCA element ("PC1") axis 602 and a second PCA element ("PC2") axis 604. The plot 600 also includes a set of reduced measurement scores 630, which includes the reduced measurement score 632 measured at a time point $t_1$. The prediction curve 605 is generated using a minimization method based on the reduced measurement scores 630. With reference to FIG. 3, the limitation boundaries 606-607 and end members 639 and 640 can be determined using a method similar to those described for block 324 and/or 326. The limitation boundary 606 separates the dimensionally reduced space between reduced measurement scores that are and are not possible based on physical sensor limits and prior sensor information corresponding with pure mud. The limitation boundary 608 separates the dimensionally reduced space between reduced measurement scores that are and are not possible based on physical sensor limits and prior sensor information corresponding with a pure formation fluid.

The reduced measurement score 632 can be used to determine a contamination level at time point $t_1$ and has a corresponding point 628 at the position on the prediction curve 605. The first distance $d_1$ for the time point $t_1$ is the distance between the corresponding point 628 and the first end member 639, and a second distance $d_2$ for the time point $t_1$ is the distance between the corresponding point 628 and the second end member 640. The contamination at time point $t_1$ can be represented as a ratio of a distance and sum of distances as shown in Equation 4 above. In addition, with further reference to block 336 of FIG. 3, the second end member 640 can be used to generate normalized sensor signals of the pure formation fluid.

Example Computer Device

Figure 7:
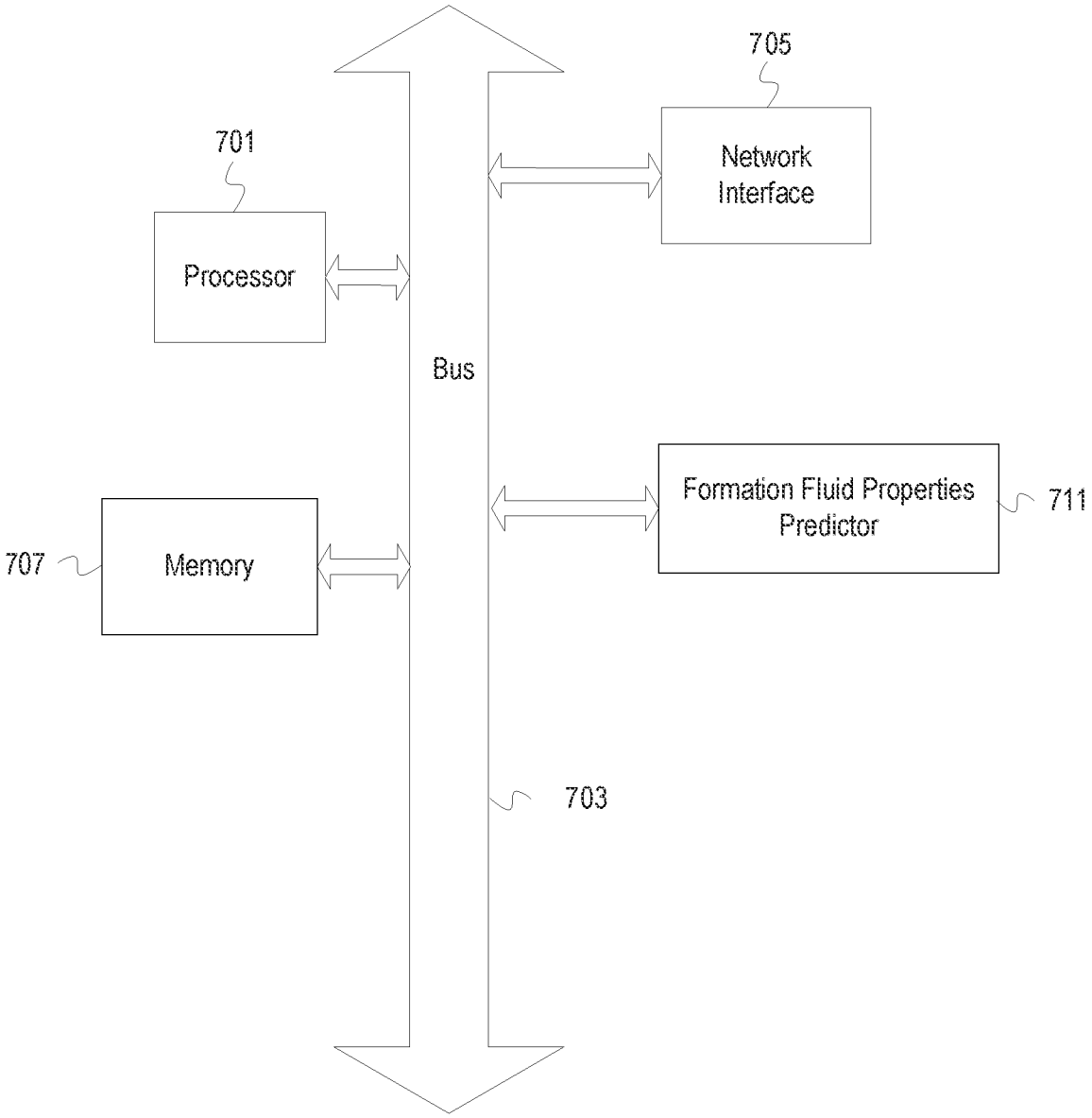
FIG. 7 depicts an example computer device.

FIG. 7 depicts an example computer device. A computer device 700 includes a processor 701 (possibly including multiple processors, multiple cores, multiple nodes, and/or implementing multi-threading, etc.). The computer device 700 includes a memory 707. The memory 707 can be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer device 700 also includes a bus 703 (e.g., PCI, ISA, PCI-Express, HyperTransport® bus, InfiniBand® bus, NuBus, etc.) and a network interface 705 (e.g., a Fiber Channel interface, an Ethernet interface, an internet small computer system interface, SONET interface, wireless interface, etc.).

The computer device 700 includes a formation fluid properties predictor 711. The formation fluid properties predictor 711 can perform one or more operations described above. For example, the formation fluid properties predictor 711 can dimensionally reduce a set of time series measurements to reduced measurement scores. Additionally, the formation fluid properties predictor 711 can determine contamination levels.

Any one of the previously described functionalities can be partially (or entirely) implemented in hardware and/or on the processor 701. For example, the functionality can be implemented with an application specific integrated circuit, in logic implemented in the processor 701, in a co-processor on a peripheral device or card, etc. Further, realizations can include fewer or additional components not illustrated in FIG. 7 (e.g., video cards, audio cards, additional network interfaces, peripheral devices, etc.). The processor 701 and the network interface 705 are coupled to the bus 703. Although illustrated as being coupled to the bus 703, the memory 707 can be coupled to the processor 701. The computer device 700 can be device at the surface and/or integrated into component(s) in the wellbore. For example, with reference to FIG. 1, the computer device 700 can be incorporated in the computer 155 and/or a computer at a remote location.

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

Variations

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EMBODIMENTS

Example embodiments include the following:

Embodiment 1: A system to determine a contamination level of a formation fluid caused by a drilling fluid, the system comprising: a formation tester tool to be positioned in a borehole, the borehole having a mixture of the formation fluid and the drilling fluid, the formation tester tool comprising a sensor to detect time series measurements from a plurality of sensor channels, the time series measurements comprising measurements of at least one attribute of the mixture of the formation fluid and the drilling fluid; a processor; and a machine-readable medium having program code executable by the processor to cause the processor to, dimensionally reduce the time series measurements to generate a set of reduced measurement scores in a multi-dimensional measurement space, determine an end member in the multi-dimensional measurement space based on the set of reduced measurement scores, wherein the end member comprises a position in the multi-dimensional measurement space that corresponds with a predetermined fluid concentration, and determine the contamination level of the formation fluid at a time point based the set of reduced measurement scores and the end member.

Embodiment 2: The system of Embodiment 1, wherein the multi-dimensional measurement space is a two-dimensional measurement space, and wherein the machine-readable medium further comprises program code executable by the processor to cause the processor to: generate a prediction curve based on the set of reduced measurement scores, wherein the end member is a first end member, and wherein the first end member is on the prediction curve in the two-dimensional measurement space; and determine a second end member, wherein the second end member is on the prediction curve in the two-dimensional measurement space.

Embodiment 3: The system of Embodiments 1 or 2, wherein the prediction curve is linear, and wherein the program code executable by the processor to cause the processor to determine the contamination level comprises program code executable by the processor to cause the processor to: determine a score based on the set of reduced measurement scores and the end member; determine a first distance between the first end member and the score; determine a second distance between the second end member and the score; and determine the contamination level based on a ratio, wherein the ratio comprising the first distance and the second distance.

Embodiment 4: The system of any of Embodiments 1-3, wherein the prediction curve is linear, and wherein the program code executable by the processor to cause the processor to determine the contamination level comprises program code executable by the processor to cause the processor to: determine a score based on the set of reduced measurement scores and the end member; determine a first distance between the first end member and a corresponding point, wherein the corresponding point is a point on the prediction curve closest to the score; determine a second distance between the second end member and the corresponding point; and determine the contamination level based on a ratio, wherein the ratio comprising the first distance and the second distance.

Embodiment 5: The system of any of Embodiments 1-4, wherein the machine-readable medium further comprises program code executable by the processor to cause the processor to: determine a property of a pure formation fluid based on the end member, wherein the predetermined fluid concentration of the end member is a pure formation fluid concentration.

Embodiment 6: The system of any of Embodiments 1-5, wherein the sensor comprises at least one of an optical sensor, a resistivity sensor, and a density sensor.

Embodiment 7: The system of any of Embodiments 1-6, wherein the machine-readable medium further comprises program code executable by the processor to cause the system to: determine prior sensor information of the sensor that comprises at least one of a prior measurement and a prior confidence level of the sensor; determine the end member based on a physical limit of the sensor and the prior sensor information; and determine a confidence associated with the contamination level based on the prior confidence level of the sensor.

Embodiment 8: The system of any of Embodiments 1-7, wherein the formation tester tool further comprises a probe to draw the mixture of the formation fluid and the drilling fluid from a formation.

Embodiment 9: One or more non-transitory machine-readable media comprising program code to determine a contamination level of a formation fluid caused by a drilling fluid, the program code to: position a formation tester tool into a borehole, the borehole having a mixture of the formation fluid and the drilling fluid, the formation tester tool comprising a sensor to detect time series measurements from a plurality of sensor channels, the time series measurements comprising measurements of at least one attribute of the mixture of the formation fluid and the drilling fluid; dimensionally reduce the time series measurements to generate a set of reduced measurement scores in a multi-dimensional measurement space; determine an end member in the multi-dimensional measurement space based on the set of reduced measurement scores, wherein the end member comprises a position in the multi-dimensional measurement space that corresponds with a predetermined fluid concentration; and determine the contamination level of the formation fluid at a time point based the set of reduced measurement scores and the end member.

Embodiment 10: The one or more non-transitory machine-readable media of Embodiment 9, wherein the multi-dimensional measurement space is a two-dimensional measurement space, and wherein the program code further comprises program code to: generate a prediction curve based on the set of reduced measurement scores, wherein the end member is a first end member, and wherein the first end member is on the prediction curve in the two-dimensional measurement space; and determine a second end member, wherein the second end member is on the prediction curve in the two-dimensional measurement space.

Embodiment 11: The one or more non-transitory machine-readable media of Embodiments 9 or 10, wherein the prediction curve is linear, and wherein the program code to determine the contamination level comprises program code to: determine a score based on the set of reduced measurement scores and the end member; determine a first distance between the first end member and the score; determine a second distance between the second end member and the score; and determine the contamination level based on a ratio, wherein the ratio comprising the first distance and the second distance.

Embodiment 12: The one or more non-transitory machine-readable media of any of Embodiments 9-11, wherein the prediction curve is linear, and wherein the program code to determine the contamination level comprises program code to: determine a score based on the set of reduced measurement scores and the end member; determine a first distance between the first end member and a corresponding point, wherein the corresponding point is a point on the prediction curve closest to the score; determine a second distance between the second end member and the corresponding point; and determine the contamination level based on a ratio, wherein the ratio comprising the first distance and the second distance.

Embodiment 13: The one or more non-transitory machine-readable media of any of Embodiments 9-12, further comprising program code to: determine a property of a pure formation fluid based on the end member, wherein the predetermined fluid concentration of the end member is a pure formation fluid concentration.

Embodiment 14: The one or more non-transitory machine-readable media of any of Embodiments 9-13, further comprising program code to: determine prior sensor information of the sensor that comprises at least one of a prior measurement and a prior confidence level of the sensor; determine the end member based on a physical limit of the sensor and the prior sensor information; and determine a confidence associated with the contamination level based on the prior confidence level of the sensor.

Embodiment 15: A method to determine a contamination level of a formation fluid caused by a drilling fluid, the method comprising: positioning a formation tester tool into a borehole, the borehole having a mixture of the formation fluid and the drilling fluid, the formation tester tool comprising a sensor to detect time series measurements from a plurality of sensor channels, the time series measurements comprising measurements of at least one attribute of the mixture of the formation fluid and the drilling fluid; dimensionally reducing the time series measurements to generate a set of reduced measurement scores in a multi-dimensional measurement space; determining an end member in the multi-dimensional measurement space based on the set of reduced measurement scores, wherein the end member comprises a position in the multi-dimensional measurement space that corresponds with a predetermined fluid concentration; and determining the contamination level of the formation fluid at a time point based the set of reduced measurement scores and the end member.

Embodiment 16: The method of Embodiment 15, wherein the multi-dimensional measurement space is a two-dimensional measurement space, and wherein the method further comprises: generating a prediction curve based on the set of reduced measurement scores, wherein the end member is a first end member, and wherein the first end member is on the prediction curve in the two-dimensional measurement space; and determining a second end member, wherein the second end member is on the prediction curve in the two-dimensional measurement space.

Embodiment 17: The method of Embodiments 15 or 16, wherein the prediction curve is linear, and wherein the method further comprises: determining a score based on the set of reduced measurement scores and the end member; determining a first distance between the first end member and the score; determining a second distance between the second end member and the score; and determining the contamination level based on a ratio, wherein the ratio comprising the first distance and the second distance.

Embodiment 18: The method of any of Embodiments 15-17, wherein the prediction curve is linear, and wherein the method further comprises: determine a score based on the set of reduced measurement scores and the end member; determine a first distance between the first end member and a corresponding point, wherein the corresponding point is a point on the prediction curve closest to the score; determine a second distance between the second end member and the corresponding point; and determine the contamination level based on a ratio, wherein the ratio comprising the first distance and the second distance.

Embodiment 19: The method of any of Embodiments 15-18, further comprising: determining a property of a pure formation fluid based on the end member, wherein the predetermined fluid concentration of the end member is a pure formation fluid concentration.

Embodiment 20: The method of any of Embodiments 15-19, further comprising: determining prior sensor information of the sensor that comprises at least one of a prior measurement and a prior confidence level of the sensor; determining the end member based on a physical limit of the sensor and the prior sensor information; and determining a confidence associated with the contamination level based on the prior confidence level of the sensor.

The invention claimed is:

1. A system to determine a contamination level of a formation fluid, the system comprising:

a formation tester tool to be positioned in a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

a processor; and a machine-readable medium having program code executable by the processor to cause the processor to, dimensionally reduce the time series measurements to generate a dimensionally reduced set of reduced measurement scores at at least one point of the time series measurements in a multi-dimensional measurement space including performing at least one transformation of a first data set of the time series measurements into a second data set having a dimensionality that is less than a dimensionality of the first data set, determine an end member in the multi-dimensional measurement space based on the dimensionally reduced set of reduced measurement scores, wherein the end member comprises a position in the multi-dimensional measurement space that corresponds with a predetermined fluid concentration, and determine the contamination level of the formation fluid at a time point based on the dimensionally reduced set of reduced measurement scores and the end member.

2. The system of claim 1, wherein the multi-dimensional measurement space is a two-dimensional measurement space, and wherein the machine-readable medium further comprises program code executable by the processor to cause the processor to:

generate a prediction curve based on the dimensionally reduced set of reduced measurement scores, wherein the end member is a first end member, and wherein the first end member is on the prediction curve in the two-dimensional measurement space; and determine a second end member, wherein the second end member is on the prediction curve in the two-dimensional measurement space.

3. The system of claim 2, wherein the prediction curve is linear, and wherein the program code executable by the processor to cause the processor to determine the contamination level comprises program code executable by the processor to cause the processor to:

determine a score based on the dimensionally reduced set of reduced measurement scores and the end member;

determine a first distance between the first end member and the score;

determine a second distance between the second end member and the score; and determine the contamination level based on a ratio, wherein the ratio comprising the first distance and the second distance.

4. The system of claim 2, wherein the prediction curve is linear, and wherein the program code executable by the processor to cause the processor to determine the contamination level comprises program code executable by the processor to cause the processor to:

determine a score based on the dimensionally reduced set of reduced measurement scores and the end member;

determine a first distance between the first end member and a corresponding point, wherein the corresponding point is a point on the prediction curve closest to the score;

determine a second distance between the second end member and the corresponding point; and determine the contamination level based on a ratio, wherein the ratio comprising the first distance and the second distance.

5. The system of claim 1, wherein the machine-readable medium further comprises program code executable by the processor to cause the system to:

determine prior sensor information of the sensor that comprises at least one of a prior measurement and a prior confidence level of the sensor;

determine the end member based on a physical limit of the sensor and the prior sensor information; and determine a confidence associated with the contamination level based on the prior confidence level of the sensor.

6. A system to determine a contamination level of a formation fluid, the system comprising:

a formation tester tool to be positioned in a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

a processor; and a machine-readable medium having program code executable by the processor to cause the processor to, dimensionally reduce the time series measurements to generate a dimensionally reduced set of reduced measurement scores at at least one point of the time series measurements in a multi-dimensional measurement space using a multi-variant factor analysis, determine an end member in the multi-dimensional measurement space based on the dimensionally reduced set of reduced measurement scores, wherein the end member comprises a position in the multi-dimensional measurement space that corresponds with a predetermined fluid concentration, and determine the contamination level of the formation fluid at a time point based on the dimensionally reduced set of reduced measurement scores and the end member.

7. A system to determine a contamination level of a formation fluid, the system comprising:

a formation tester tool to be positioned in a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

a processor; and a machine-readable medium having program code executable by the processor to cause the processor to, dimensionally reduce the time series measurements to generate a dimensionally reduced set of reduced measurement scores at at least one point of the time series measurements in a multi-dimensional measurement space using a multi-variant fitting, determine an end member in the multi-dimensional measurement space based on the dimensionally reduced set of reduced measurement scores, wherein the end member comprises a position in the multi-dimensional measurement space that corresponds with a predetermined fluid concentration, and determine the contamination level of the formation fluid at a time point based on the dimensionally reduced set of reduced measurement scores and the end member.

8. One or more non-transitory machine-readable media comprising program code to determine a contamination level of a formation fluid, the program code to:

position a formation tester tool into a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

dimensionally reduce the time series measurements to generate a dimensionally reduced set of measurement scores at at least one point of the time series measurements in a multi-dimensional measurement space including program code to perform at least one transformation of a first data set of the time series measurements into a second data set having a dimensionality that is less than a dimensionality of the first data set;

determine an end member in the multi-dimensional measurement space based on the dimensionally reduced set of measurement scores, wherein the end member comprises a position in the multi-dimensional measurement space that corresponds with a predetermined fluid concentration; and determine the contamination level of the formation fluid at a time point based on the dimensionally reduced set of measurement scores and the end member.

9. The one or more non-transitory machine-readable media of claim 8, wherein the multi-dimensional measurement space is a two-dimensional measurement space, and wherein the program code further comprises program code to:

generate a prediction curve based on the dimensionally reduced set of measurement scores, wherein the end member is a first end member, and wherein the first end member is on the prediction curve in the two-dimensional measurement space; and determine a second end member, wherein the second end member is on the prediction curve in the two-dimensional measurement space.

10. The one or more non-transitory machine-readable media of claim 9, wherein the prediction curve is linear, and wherein the program code to determine the contamination level comprises program code to:

determine a score based on the dimensionally reduced set of measurement scores and the end member;

determine a first distance between the first end member and the score;

determine a second distance between the second end member and the score; and determine the contamination level based on a ratio, wherein the ratio comprising the first distance and the second distance.

11. One or more non-transitory machine-readable media comprising program code to determine a contamination level of a formation fluid, the program code to:

position a formation tester tool into a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

dimensionally reduce the time series measurements to generate a dimensionally reduced set of measurement scores at at least one point of the time series measurements in a multi-dimensional measurement space using a multi-variant factor analysis;

determine an end member in the multi-dimensional measurement space based on the dimensionally reduced set of measurement scores, wherein the end member comprises a position in the multi-dimensional measurement space that corresponds with a predetermined fluid concentration; and determine the contamination level of the formation fluid at a time point based on the dimensionally reduced set of measurement scores and the end member.

12. One or more non-transitory machine-readable media comprising program code to determine a contamination level of a formation fluid, the program code to:

position a formation tester tool into a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

dimensionally reduce the time series measurements to generate a dimensionally reduced set of measurement scores at at least one point of the time series measurements in a multi-dimensional measurement space using a multi-variant fitting;

determine an end member in the multi-dimensional measurement space based on the dimensionally reduced set of measurement scores, wherein the end member comprises a position in the multi-dimensional measurement space that corresponds with a predetermined fluid concentration; and determine the contamination level of the formation fluid at a time point based on the dimensionally reduced set of measurement scores and the end member.

13. A method to determine a contamination level of a formation fluid, the method comprising:

positioning a formation tester tool into a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

dimensionally reducing the time series measurements to generate a dimensionally reduced set of measurement scores at at least one point of the time series measurements in a multi-dimensional measurement space including performing at least one transformation of a first data set of the time series measurements into a second data set having a dimensionality that is less than a dimensionality of the first data set;

determining an end member in the multi-dimensional measurement space based on the dimensionally reduced set of measurement scores, wherein the end member comprises a position in the multi-dimensional measurement space that corresponds with a predetermined fluid concentration; and determining the contamination level of the formation fluid at a time point based on the dimensionally reduced set of measurement scores and the end member.

14. The method of claim 13, wherein the multi-dimensional measurement space is a two-dimensional measurement space, and wherein the method further comprises:

generating a prediction curve based on the dimensionally reduced set of measurement scores, wherein the end member is a first end member, and wherein the first end member is on the prediction curve in the two-dimensional measurement space; and determining a second end member, wherein the second end member is on the prediction curve in the two-dimensional measurement space.

15. The method of claim 14, wherein the prediction curve is linear, and wherein the method further comprises:

determining a score based on the dimensionally reduced set of measurement scores and the end member;

determining a first distance between the first end member and the score;

determining a second distance between the second end member and the score; and determining the contamination level based on a ratio, wherein the ratio comprising the first distance and the second distance.

16. A method to determine a contamination level of a formation fluid, the method comprising:

positioning a formation tester tool into a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

dimensionally reducing the time series measurements to generate a dimensionally reduced set of measurement scores at at least one point of the time series measurements in a multi-dimensional measurement space using a multi-variant factor analysis;

determining an end member in the multi-dimensional measurement space based on the dimensionally reduced set of measurement scores, wherein the end member comprises a position in the multi-dimensional measurement space that corresponds with a predetermined fluid concentration; and determining the contamination level of the formation fluid at a time point based on the dimensionally reduced set of measurement scores and the end member.

17. A method to determine a contamination level of a formation fluid, the method comprising:

positioning a formation tester tool into a borehole, the borehole having a mixture of the formation fluid and a drilling fluid, the formation tester tool comprising a sensor to detect time series measurements from a plurality of sensor channels, the time series measurements comprising measurements of at least one attribute of the mixture of the formation fluid and the drilling fluid;

dimensionally reducing the time series measurements to generate a dimensionally reduced set of measurement scores at at least one point of the time series measurements in a multi-dimensional measurement space using a multi-variant fitting;

determining an end member in the multi-dimensional measurement space based on the dimensionally reduced set of measurement scores, wherein the end member comprises a position in the multi-dimensional measurement space that corresponds with a predetermined fluid concentration; and determining the contamination level of the formation fluid at a time point based on the dimensionally reduced set of measurement scores and the end member.

* * * * *